US008717250B2

(12) United States Patent
Nilsson

(10) Patent No.: US 8,717,250 B2
(45) Date of Patent: May 6, 2014

(54) ENHANCED BAND MULTIPLE POLARIZATION ANTENNA ASSEMBLY

(75) Inventor: Jack Nilsson, Medina, OH (US)

(73) Assignee: MP Antenna Ltd, North Ridgeville, OH (US)

( * ) Notice: Subject to any disclaimer, the term of this patent is extended or adjusted under 35 U.S.C. 154(b) by 392 days.

(21) Appl. No.: 13/071,167

(22) Filed: Mar. 24, 2011

(65) Prior Publication Data

US 2011/0227804 A1 Sep. 22, 2011

Related U.S. Application Data

(63) Continuation-in-part of application No. 12/127,735, filed on May 27, 2008, now Pat. No. 7,916,097.

(51) Int. Cl.
*H01Q 21/00* (2006.01)

(52) U.S. Cl.
USPC ..... 343/893

(58) Field of Classification Search
USPC ..... 343/893, 711–715, 700 MS, 789, 840
See application file for complete search history.

(56) References Cited

U.S. PATENT DOCUMENTS

| | | | | |
|---|---|---|---|---|
| 4,253,099 | A | 2/1981 | Yamazaki et al. | |
| 4,788,551 | A | 11/1988 | Ishida | |
| 5,177,493 | A | 1/1993 | Kawamura | |
| 6,198,454 | B1 | 3/2001 | Sharp et al. | |
| 6,358,909 | B1 | 3/2002 | Ochomogo et al. | |
| 6,486,849 | B2 | 11/2002 | Buckles | |
| 6,693,600 | B1 * | 2/2004 | Elliot | 343/773 |
| 6,940,457 | B2 | 9/2005 | Lee et al. | |
| 7,327,315 | B2 * | 2/2008 | Starkie et al. | 343/700 MS |
| 7,411,560 | B2 * | 8/2008 | Jordan | 343/725 |
| 8,284,110 | B2 * | 10/2012 | Elliot et al. | 343/727 |
| 2003/0122719 | A1 | 7/2003 | Nilsson et al. | |
| 2004/0164917 | A1 | 8/2004 | Nilsson | |
| 2004/0164918 | A1 | 8/2004 | Nilsson | |
| 2007/0046548 | A1 | 3/2007 | Pros et al. | |
| 2007/0152894 | A1 | 7/2007 | Sanz et al. | |

FOREIGN PATENT DOCUMENTS

| | | |
|---|---|---|
| EP | 0 225 460 A2 | 6/1987 |
| GB | 1 223 778 | 3/1971 |

* cited by examiner

*Primary Examiner* — Huedung Mancuso
(74) *Attorney, Agent, or Firm* — Tarolli, Sundheim, Covell & Tummino LLP

(57) ABSTRACT

Antenna assemblies are provided for receiving and transmitting radio frequency signals over an enhanced frequency band. An assembly includes an electrically conductive ground reference and a radiative element formed from an electrically conductive material and comprising an apex. The radiative element is electrically connected to an antenna feed at the apex and configured such that the radiative element lacks two-fold rotational symmetry around a first axis coinciding with the antenna feed. The radiative element extends such that a distance between the radiative element and the electrically conductive ground reference increases as a radial distance from the first axis along the radiative element increases.

17 Claims, 8 Drawing Sheets

ENHANCED BAND MULTIPLE POLARIZATION ANTENNA ASSEMBLY

RELATED APPLICATIONS

This application is a continuation-in-part of U.S. patent application Ser. No. 12/127,735, filed May 27, 2008, now U.S. Pat. No. 7,916,097, issued Mar. 29, 2011, the subject matter, which is hereby incorporated by reference.

TECHNICAL FIELD

Certain embodiments of the present invention relate to antennas for wireless communications. More particularly, certain embodiments of the present invention relate to an apparatus and method providing a multi-band, wide-band, or broadband multi-polarized antenna exhibiting substantial spatial diversity for use in point-to-point and point-to-multi-point communication applications for the Internet, land, maritime, aviation, and space.

BACKGROUND OF THE INVENTION

For years, wireless communications have struggled with limitations of audio/video/data transport and internet connectivity in both obstructed (indoor/outdoor) and line-of-site (LOS) deployments. A focus on antenna gain as well as circuitry solutions has proven to have significant limitations. Unresolved, non-optimized (leading edge) technologies have often given way to "bleeding edge" attempted resolutions. Unfortunately, all have fallen short of desirable goals.

While lower frequency radio waves benefit from an 'earth hugging' propagation advantage, higher frequencies do inherently benefit from (multi-) reflection/penetrating characteristics. However, with topographical changes (hills & valleys) and object obstructions (e.g., natural such as trees, and man-made such as buildings/walls) and with the resultant reflections, diffractions, refractions and scattering, maximum signal received may well be off-axis (non-direct path) and multi-path (partial) cancellation of signals results in null/weaker spots. Also, some antennas may benefit from having gain at one elevation angle ('capturing' signals of some pathways), while other antennas have greater gain at another elevation angle, each type being insufficient where the other does well. In addition, the radio wave can experience altered polarizations as they propagate, reflect, refract, diffract, and scatter. A very preferred (polarization) path may exist; however, insufficient capture of the signal can result if this preferred path is not utilized.

BRIEF SUMMARY OF THE INVENTION

In accordance with an aspect of the invention, an antenna assembly is provided for receiving and transmitting radio frequency signals over an enhanced frequency band. The assembly includes an electrically conductive ground reference and a radiative element formed from an electrically conductive material and comprising an apex. The radiative element is electrically connected to an antenna feed at the apex and configured such that the radiative element lacks two-fold rotational symmetry around a first axis coinciding with the antenna feed. The radiative element extends such that a distance between the radiative element and the electrically conductive ground reference increases as a radial distance from the first axis along the radiative element increases.

In accordance with another aspect of the invention, an antenna assembly is provided for receiving and transmitting radio frequency signals over an enhanced frequency band. A first radiative element is formed from an electrically conductive material and includes an oblique, elliptical cone operatively connected to an antenna feed at an apex. A second radiative element is formed from an electrically conductive material and includes an oblique, elliptical cone operatively connected to the antenna feed at an apex. The assembly further includes an electrically conductive ground reference.

In accordance with yet another aspect of the present invention, an antenna assembly is provided for receiving and transmitting radio frequency signals over an enhanced frequency band. The assembly includes an electrically conductive ground reference. A first radiative element is formed from an electrically conductive material and comprising a first apex, at which the first radiative element is electrically connected to an antenna feed. The first radiative element extends such that a distance between the first radiative element and the electrically conductive ground reference increases as a radial distance from the first axis along the first radiative element increases. A second radiative element is formed from an electrically conductive material and includes a second apex, at which the second radiative element is electrically connected to the antenna feed and the first radiative element. The second radiative element extends such that a distance between the second radiative element and the electrically conductive ground reference increases as a radial distance from the first axis along the second radiative element increases. The first radiative element and the second radiative element have different lengths. The length of the first radiative element is associated with a first characteristic frequency of the antenna assembly, and the length of the second radiative element is associated with a second characteristic frequency of the antenna assembly.

DETAILED DESCRIPTION OF THE INVENTION

Figure 1:
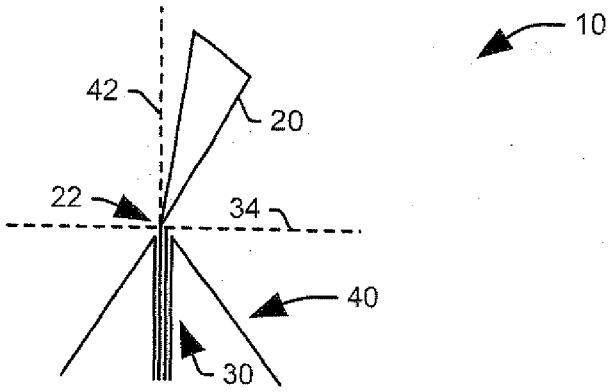
FIG. 1 illustrates an enhanced band, multi-polarized antenna for transmitting and receiving radio frequency signals in accordance with various aspects of the present invention.

Generally stated, a novel three-dimensionally constructed antenna with in-built spatial diversity (one part perhaps in a "null spot," while another part of the antenna in a "hot spot"), relatively broad signal patterning, and in-built polarization diversity serves to stabilize signal and throughput (e.g., minimizing packet retries and Ethernet rejects) in the real "obstructed," often dynamic world. FIG. 1 illustrates a first embodiment of an enhanced band, multi-polarized antenna 10 for transmitting and receiving radio frequency signals in accordance with various aspects of the present invention. It will be appreciated that the term "radio frequency," is intended to encompass frequencies within the microwave and traditional radio bands, specifically frequencies between 3 kHz and 3 THz. Further, the term "enhanced band" is intended to refer to wideband and multiband applications.

The antenna comprises that includes a radiative element 20 formed from a conductive material and comprising at least one apex 22. The radiative element 20 is connected to an antenna feed 30 at the apex 22. The radiative element 20 is located to a first side of an imaginary plane 34. It will be appreciated that additional radiative elements (not shown) can be utilized in the driven element in accordance with various implementations of the invention.

Electromagnetic waves are often reflected, diffracted, refracted, and scattered by surrounding objects, both natural and man-made. As a result, electromagnetic waves that are approaching a receiving antenna can be arriving from multiple angles and have multiple polarizations and signal levels. The antenna 10 illustrated in FIG. 1 is configured to capture or utilize the preferred approaching signal whether the preferred signal is a line-of-sight (LOS) signal or a reflected signal, and no matter how the signal is polarized. In the illustrated antenna 10, the radiative member is positioned over a ground plane and configured to allow signals of diverse polarizations to generate and/or receive in various different directions. Therefore, such a driven element is said to be "multi-polarized" as well as providing "geometric spatial capture of signal". If a driven element produced all polarizations in all planes (e.g., all planes in an x, y, z coordinate system) and the receiving antenna is capable of capturing all polarizations in all planes, then the significantly greatest preferred polarization path, that is the signal path allowing for maximum signal amplitude, may be utilized, as well as well as a variety of polarization diverse and spatially diverse resultant signals.

A conductive ground plane structure 40 can be located at the imaginary plane or on a second side of the imaginary plane 34. The ground plane structure 40 is illustrated herein as a conical member, but it will be appreciated that the ground plane structure can be configured in any of a number of ways. For example, a planar or cylindrical ground plane can be utilized. Further, the ground plane structure 40 does not need to be a single, solid structure. For example, the ground plane can be implemented as a conductive mesh or comprise a number of discrete conductive elements evenly spaced around the apex point 22.

In accordance with an embodiment of the present invention, the radiative element 20 is configured to lack two-fold rotational symmetry around a first axis 42 that coincides with the antenna feed 30. Further, the radiative element 20 extends from the antenna feed 30 such that a distance between the radiative element and the electrically conductive ground reference 40 increases as a radial distance from the first axis 42 along the radiative element increases. By continuously varying the distance between the radiative element 20 and the ground reference, it is possible to introduce enhanced band sensitivity to the antenna assembly without significantly increasing the size and complexity of the antenna assembly. Further, as will be explained in detail below, the asymmetric implementation of the driven portion of the antenna assembly 10 (e.g., the radiative element 20) avoids the cancellation of secondary interactions between the driven elements (e.g., 20) and the ground plane structure 40 that can enhance the polarization diversity of the antenna as well as its receptivity along the first axis 42.

Figure 2:
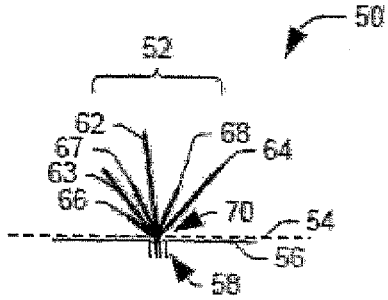
FIG. 2 illustrates a side view of a first exemplary implementation of an antenna assembly in accordance with an aspect of the present invention.
Figure 3:
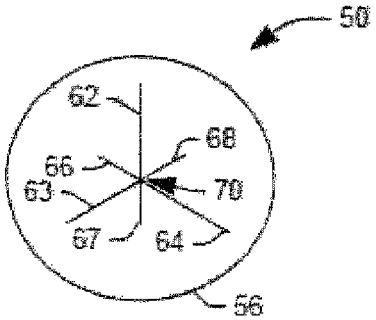
FIG. 3 illustrates an overhead view of a first exemplary implementation of an antenna assembly in accordance with an aspect of the present invention.

FIG. 2 illustrates a side view of a first exemplary implementation of an antenna assembly 50 in accordance with an aspect of the present invention. FIG. 3 illustrates an overhead view of the first exemplary implementation of the antenna assembly. The illustrated antenna assembly 50 comprises a driven antenna assembly 52 located on a first side of an imaginary plane 54, and a ground reference 56 located at the imaginary plane or on a second side of the imaginary plane.

The driven antenna assembly 52 can be driven by an antenna feed that is electrically connected to the driven antenna assembly approximately at the imaginary plane 54. In the illustrated implementation, the ground reference 56 is illustrated as planar, but it will be appreciated that other configurations of the ground plane can be utilized within the illustrated antenna assembly. The ground reference 56 may be comprised of any appropriate electrically conductive material such as, for example, copper or stainless steel. The radius of the ground reference 56 is at least one-quarter of a wavelength of the lowest frequency of operation.

The surface of the ground reference 56 may be continuous or may be a crosshatched wired mesh, in accordance with various embodiments of the present invention. In addition, three or more linear elements disposed in a substantially conical shape may form the ground reference, in accordance with an embodiment of the present invention. In other implementations, the ground reference 56 can include a conical assembly or a cylindrical sleeve having a closed upper base side. Alternatively, the shield of a coaxial associated with the antenna feed can serve as the ground reference, and various styles of stubs, sleeves, matching systems, baluns, transformers, etc. may also be used. The antenna feed 58 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect to the driven antenna assembly 52 and allows a ground braid of the coaxial cable to electrically connect to the ground reference 56. A dielectric material can be used to electrically insulate the center conductor and the driven antenna assembly 52 from the ground reference 56.

The driven antenna assembly 52 comprises six radiative elements 62-64 and 66-68 that radiate out from a common apex 70. The driven antenna assembly 52 and its constituent elements 62-64 and 66-68 are formed from a conductive material. The radiative elements 62-64 and 66-68 are electrically connected to the antenna feed 58 and one another at the apex 70. A first set of radiative elements comprise first, second, and third radiative elements 62-64 that are generally linear and extend away from the apex 70 at an acute angle relative to the imaginary plane 54. Each of the first, second, and third radiative antenna elements 62-64 may be at a unique acute angle or at the same acute angle relative to the imaginary plane 54. In the illustrated implementation, the first, second, and third radiative elements 62-64 are oriented such that the first, second, and third elements are spaced evenly, that is, at intervals of one-hundred and twenty degrees. Each of the first set of radiative elements 62-64 have a length within a first range of lengths associated with a first characteristic frequency. For example, a first element 62 can have a length, $L_1$, tuned to be receptive to the first characteristic frequency and each of the second and third elements 63 and 64 can have a length within an approximately ten percent variance of the length of the first element. Varying the lengths of the first set of radiative elements 62-64 can provide an improvement in the broadband properties of the driven antenna assembly, but it will be appreciated that a common antenna length, for example, the tuned antenna length $L_1$, can be utilized for the first set of radiative elements while still maintaining the wideband properties of the antenna.

A second set of radiative elements comprise fourth, fifth, and sixth radiative elements 66-68 that are generally linear and extend away from the apex 70 at an acute angle relative to the imaginary plane 54. Each of the fourth, fifth, and sixth radiative antenna elements 66-68 may be at a unique acute angle or at the same acute angle relative to the imaginary plane 54 as one another or one of the first set of radiative elements 62-64. In the illustrated implementation, the fourth, fifth, and sixth radiative elements 66-68 are oriented such that they are spaced evenly between the first set of radiative elements 62-64, such that each of the second set of radiative elements is spaced at sixty degree intervals from two of the first set of radiative elements and at intervals of one-hundred and twenty degrees from one another. Each of the second set of radiative elements 66-68 have a length within a second range of lengths associated with a second characteristic frequency. For example, the fourth element 66 can have a length, $L_2$, tuned to be receptive to the second characteristic frequency and each of the fifth and sixth elements 67 and 68 can have a length within an approximately ten percent variance of the length of the fourth element. The lengths of the radiative elements 62-64 and 66-68 can be configured such that the first range of lengths and the second range of lengths do not overlap.

In the illustrated implementation, the antenna assembly 50 is designed with a first characteristic frequency of 2.4 GHz and a second characteristic frequency of 5 GHz, allowing the antenna to operate at a wide band of radio frequencies ranging from approximately 2.0 GHz to approximately 11 GHz. The lengths of the first set of radiative elements 62-64 can be tuned to a frequency of 2.4 GHz, with the first radiative element 62 having a length of approximately 0.875 inches, the second radiative element 63 being shorter by a factor less than ten percent (e.g., ~0.813 inches) and the third radiative element 64 can longer by a factor less than ten percent (e.g., 0.938 inches). The lengths of the second set of radiative elements 66-68 can be tuned to a frequency of 5 GHz, such that the fourth radiative element 66 has a length of approximately 0.563 inches, the fifth radiative element 67 can be shorter by a factor less than ten percent (e.g., ~0.5 inches) and the sixth radiative element 68 can be longer by a factor of less than ten percent (e.g., 0.625 inches). Each of the radiative elements can have a diameter of approximately one-sixteenth of an inch. By implementing the driven antenna assembly 52 as a series of elements of varying lengths, an ultra wide band, multi-polarized antenna assembly can be realized. It will be appreciated, however, that by varying the width (e.g., diameter) of the radiative elements 62-64 and 66-68 and the width of the ground reference 56 will also vary the degree of broadband characteristics.

In accordance with an aspect of the present invention, each of the first and second sets of radiative elements 62-64 and 66-68 can be generalized to only two or greater than three elements having similar length and orientation. For example, in place of the first set of radiative elements 62-64, four radiative elements, circumferentially spaced at intervals of ninety degrees, or otherwise, may be used. In fact, in one implementation, the first and second sets of radiative elements 62-64 and 66-68 may be effectively replaced with a continuous surface of a cone, a pyramid, or some other continuous shape that is spatially diverse on one side (e.g., has significant spatial extent) and comes substantially to a point (e.g., an apex) on the other side. For example, in accordance with an aspect of the present invention, a linear radiative member connected at one end to a radiative loop having a certain spatial extent may be used.

Figure 4:
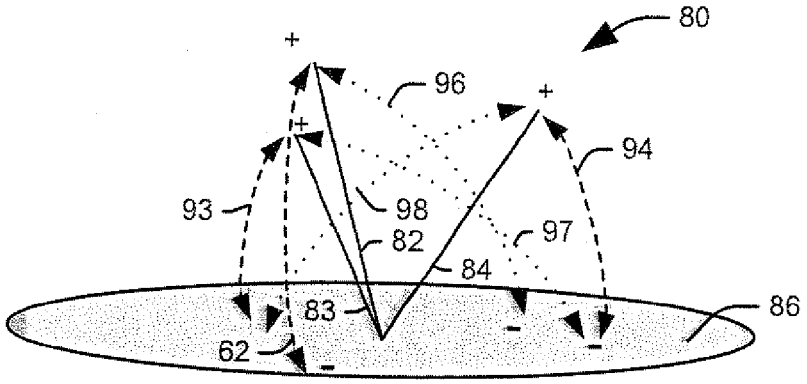
FIG. 4 illustrates the electric field diversity provided by an antenna assembly similar to that illustrated in FIGS. 2 and 3.

FIG. 4 illustrates the electric field diversity provided by an antenna assembly 80 similar to that illustrated in FIGS. 2 and 3. In the exemplary implementation, the antenna assembly 80 comprises three linear radiative elements 82-84 and a planar, conductive ground assembly 86. It will be appreciated, however, that the antenna assembly can include more than three radiative elements, arranged in a manner consistent with the example assembly 80 provided. Each radiative element 82-84 produces a corresponding electric field with a first component 92-94 that has a slant orientation that is primarily perpendicular to the planar ground assembly 86. Accordingly, the antenna assembly 80 can achieve substantial connectivity with a receiver having a polarization substantially perpendicular to the ground plane assembly 86, particularly at and near the horizon of the antenna pattern.

As is illustrated in FIG. 4, however, the electrical field produced at each radiative element also includes a second component 96-98 having a slant orientation that is primarily parallel to the planar ground assembly 86. It will be appreciated that the illustrated electrical field lines are merely exemplary, and that this slant polarized electric field will radiate in substantially all directions. The second component 96-98 provides substantial connectivity with a receiver having a polarization substantially parallel to the ground plane assembly 86 around the horizon, as well a substantial field component along an axis perpendicular to the ground plane. Further, it will be appreciated that the first 92-94 and second 96-98 components of the electric field are substantially orthogonal and out-of-phase, providing a slight elliptical polarization at and near the horizon. In accordance with an aspect of the present invention, the second component 96-98 of the electric field is created by the arrangement and differing lengths of the radiative elements. If the radiative elements were symmetric and of equal length, the slant polarization would combine to a vertical polarization field at the horizon, and therefore the additional connectivity provided by the additional electrical field would be lost.

Figure 5:
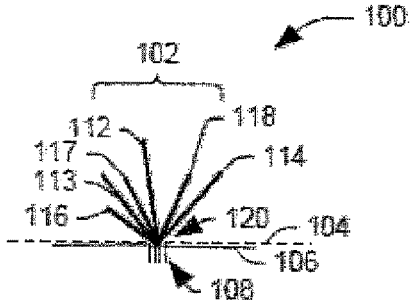
FIG. 5 illustrates a side view of a second exemplary implementation of an antenna assembly in accordance with an aspect of the present invention.
Figure 6:
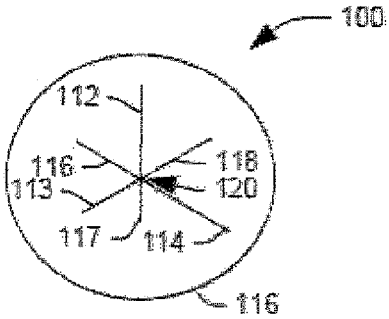
FIG. 6 illustrates an overhead view of a second exemplary implementation of an antenna assembly in accordance with an aspect of the present invention.

FIG. 5 illustrates a side view of a second exemplary implementation of an antenna assembly 100 in accordance with an aspect of the present invention. FIG. 6 illustrates an overhead view of the second exemplary implementation of the antenna assembly. The illustrated antenna assembly 100 comprises a driven antenna assembly 102 located on a first side of an imaginary plane 104, and a ground reference 106 located at the imaginary plane or on a second side of the imaginary plane. The driven antenna assembly 102 can be driven by an antenna feed that is electrically connected to the driven antenna assembly approximately at the imaginary plane 104. In the illustrated implementation, the ground reference 106 is illustrated as planar, but it will be appreciated that other configurations of the ground plane can be utilized within the illustrated antenna assembly. The ground reference 106 may be comprised of any appropriate electrically conductive material such as, for example, copper or stainless steel. The radius of the ground reference 106 is at least one-quarter of a wavelength associated with the lowest frequency of operation.

The surface of the ground reference 106 may be continuous or may be a crosshatched wired mesh, in accordance with various embodiments of the present invention. In addition, three or more linear elements disposed in a substantially conical shape may form the ground reference, in accordance with an embodiment of the present invention. In other implementations, the ground reference 106 can include a conical assembly or a cylindrical sleeve having a closed upper base side. Alternatively, the shield of a coaxial associated with the antenna feed can serve as the ground reference, and various styles of stubs, sleeves, matching systems, baluns, transformers, etc. may also be used. The antenna feed 108 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 102 and allows a ground braid of the coaxial cable to electrically connect to the ground reference 106. A dielectric material can be used to electrically insulate the center conductor and the driven antenna assembly 102 from the ground reference 106.

The driven antenna assembly 102 comprises six radiative elements 112-114 and 116-118 that radiate out from a common apex 120. The driven antenna assembly 102 and its constituent elements 112-114 and 116-118 are formed from a conductive material. The radiative elements 112-114 and 116-118 are electrically connected to the antenna feed 108 and one another at the apex 120. A first set of radiative elements comprise first, second, and third radiative elements 112-114 that are generally linear and extend away from the apex 120 at an acute angle relative to the imaginary plane 104. Each of the first, second, and third radiative antenna elements 112-114 may be at a unique acute angle or at the same acute angle relative to the imaginary plane 104. In the illustrated implementation, the first, second, and third radiative elements 112-114 are oriented such that the first, second, and third elements are spaced evenly, that is, at intervals of one-hundred and twenty degrees. Each of the first set of radiative elements 112-114 have a length within a first range of lengths associated with a characteristic lower bound frequency. For example, a first element 112 can have a length, $L_1$, tuned to be receptive to the characteristic lower bound frequency and each of the second and third elements 113 and 114 can have a length within an approximately ten percent variance of the length of the first element. Varying the lengths of the first set of radiative elements 112-114 can provide an improvement in the broadband properties of the driven antenna assembly, but it will be appreciated that a common antenna length, for example, the tuned antenna length $L_1$, can be utilized for the first set of radiative elements in while still maintain the wideband properties of the antenna.

A second set of radiative elements comprise fourth, fifth, and sixth radiative elements 116-118 that are generally linear and extend away from the apex 120 at an acute angle relative to the imaginary plane 104. Each of the fourth, fifth, and sixth radiative antenna elements 116-118 may be at a unique acute angle or at the same acute angle relative to the imaginary plane 104 as one another or one of the first set of radiative elements 112-114. In the illustrated implementation, the fourth, fifth, and sixth radiative elements 116-118 are oriented such that they are spaced evenly between the first set of radiative elements 112-114, such that each of the second set of radiative elements is spaced at sixty degree intervals from two of the first set of radiative elements and at intervals of one-hundred and twenty degrees from one another. Each of the second set of radiative elements 116-118 have a length in a second range around a length of approximately four-fifths the tuned length associated with the characteristic frequency. In one implementation, the length of each of the second set of radiative elements 116-118 can be equal to four-fifths the length of a corresponding one of the first set of radiative elements 112-114.

In the illustrated implementation, the antenna assembly 100 is designed with a characteristic lower bound frequency around 700 MHz, and the lengths of the first set of radiative elements 112-114 selected as to tune the antenna to that frequency. In the illustrated implementation, the first radiative element 112 can have a length of approximately 3.19 inches, the second radiative element 113 can have a length of approximately 2.88 inches, and the third radiative element 114 can have a length of approximately 3.25 inches). The lengths of the second set of radiative elements 116-118 can be cut to approximately four-fifths the length of the first set of radiative elements 112-114. Accordingly, the fourth radiative element 116 can have a length of around 2.56 inches, the fifth radiative element 117 can have a length approximately 2.31 inches, and the sixth radiative element 118 can have a length of approximately 2.63 inches. Each element 112-114 can have a diameter of approximately one-sixteenth of an inch, and the planar ground reference 106 can have a diameter of eleven inches. The illustrated antenna 100 can operate at an extremely wide band of radio frequencies ranging from approximately 700 MHz to approximately 6 GHz.

In accordance with an aspect of the present invention, each of the first and second sets of radiative elements 112-114 and 116-118 can be generalized to only two or greater than three elements having similar length and orientation. For example, in place of the first set of radiative elements 112-114, four radiative elements, circumferentially spaced at intervals of ninety degrees, or otherwise, may be used. In fact, the first and second sets of radiative elements 112-114 and 116-118 may be effectively replaced with a continuous surface of a cone, a pyramid, or some other continuous shape that is spatially diverse on one side (e.g., has significant spatial extent) and comes substantially to a point (e.g., an apex) on the other side. For example, in accordance with an aspect of the present invention, a linear radiative member connected at one end to a radiative loop having a certain spatial extend may be used.

Figure 7:
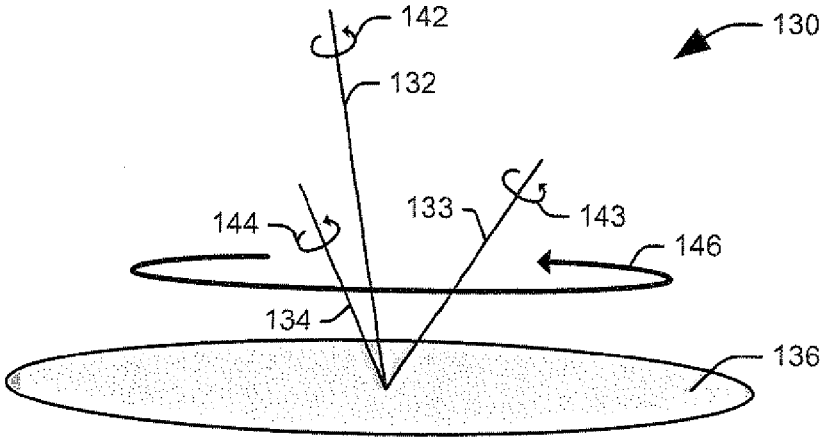
FIG. 7 illustrates the magnetic field diversity such as that provided by an antenna assembly 130 similar to that illustrated in FIGS. 2, 3, 5, and 6.

FIG. 7 illustrates the magnetic field diversity such as that provided by an antenna assembly 130 similar to that illustrated in FIGS. 2, 3, 5, and 6. In the exemplary implementation, the antenna assembly 130 comprises three linear radiative elements 132-134 and a planar, conductive ground assembly 136. The three radiative elements 132-134 are fed in phase, such that the magnetic fields 142-144 produced by the radiative elements are substantially aligned. One benefit of this arrangement is the enhanced signal provided by the combined field 146, due to a significant increase in the magnetic field differentials produced by the antenna assembly. Another benefit of the design lies in the spatial diversity provided by the antenna assembly 130, allowing for superior signal reception for a transmitted signal of a given strength. Just as a magnetic coil provides a greater inducted current than a straight wire within a magnetic field of a given strength, the spatially diverse antenna assembly 130 provides greater receptivity than a standard dipole antenna.

Figure 8:
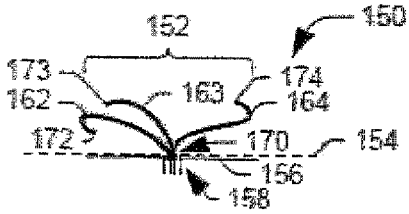
FIG. 8 illustrates a side view of a third exemplary implementation of an antenna assembly in accordance with an aspect of the present invention.

FIG. 8 illustrates a side view of a third exemplary implementation of an antenna assembly 150 in accordance with an aspect of the present invention. The illustrated antenna assembly 150 comprises a driven antenna assembly 152 located on a first side of an imaginary plane 154, and a ground reference 156 located at the imaginary plane or on a second side of the imaginary plane. The driven antenna assembly 152 can be driven by an antenna feed that is electrically connected to the driven antenna assembly approximately at the imaginary plane 154. In the illustrated implementation, the ground reference 156 is illustrated as planar, but it will be appreciated that other configurations of the ground plane can be utilized within the illustrated antenna assembly. The ground reference 156 may be comprised of any appropriate electrically conductive material such as, for example, copper or stainless steel. The antenna feed 158 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 152 and allows a ground braid of the coaxial cable to electrically connect to the ground reference 156. A dielectric material can be used to electrically insulate the center conductor and the driven antenna assembly 152 from the ground reference 156.

The driven antenna assembly 152 comprises three radiative elements 162-164 that spiral outward from a common apex 170. It will be appreciated, however, that one element, two elements, or more than three elements can also be utilized. The driven antenna assembly 152 and its constituent elements 162-164 are formed from a conductive material. The radiative elements 162-164 are electrically connected to the antenna feed 158 and one another at respective first ends at the apex 170. Each of the radiative elements 162-164 are curvilinear and radiate away from the apex 170. In the illustrated implementation, the first, second, and third radiative elements 162-164 are oriented such that the first, second, and third elements are spaced evenly as they leave the apex 170, that is, at intervals of one-hundred and twenty degrees.

Each of the first set of radiative elements 162-164 has a length within a first range of lengths associated with a first characteristic frequency. It will be appreciated that length, as used herein, refers to the straightened length of the element, as opposed to the distance it extend from the apex 170. For example, a first element 162 can have a length, $L_1$, tuned to be receptive to the first characteristic frequency and each of the second and third elements 163 and 164 can have a length within an approximately ten percent variance of the length of the first element. Varying the lengths of the radiative elements 162-164 can provide an improvement in the broadband properties of the driven antenna assembly, but it will be appreciated that a common antenna length, for example, the tuned antenna length $L_1$, can be utilized for the first set of radiative elements in while still maintain the enhanced band properties of the antenna.

In accordance with an aspect of the present invention, the radiative elements 162-164 can be curved such that respective second ends 172-174 of the radiative elements are located at a predetermined height above the ground reference 156. This height can be selected to be approximately one-quarter of a wavelength associated with a second characteristic frequency. The rate of ascent of the curvilinear elements 162-164 can be relatively high until this height is approached and then significantly slowed to maximize the length of the curvilinear element at or near this height. By curving the curvilinear elements 162-164 in this manner, an additional degree of capacitive and inductive coupling between the elements 162-164 and the ground reference 156 can be established, allowing the antenna increased sensitivity around the second characteristic frequency. Accordingly, the illustrated antenna assembly 150 is sensitive to frequencies in bands around both the first characteristic frequency and the second characteristic frequency, allowing for true dual-band operation from a single driven radiative assembly.

In accordance with an aspect of the present invention, the polarization diversity of the antenna assembly 150 around the horizon can be greatly enhanced through the use of the curvilinear elements 162-164. In the illustrated antenna assembly 150, the radiation pattern includes alternating horizontally and vertically polarized lobes around the horizon of the pattern, allowing the antenna to be responsive to multiple polarizations even at a low elevation. This alternating horizontal and vertical polarization is particularly useful in dynamic environments and mobile applications. The use of the curvilinear elements 162-164 also allows for a significant reduction in the size of the ground reference 156, such that the radius of the ground reference can be significantly smaller than one-quarter of the wavelength associated with the lowest frequency of operation.

In the illustrated implementation, the antenna assembly 150 is designed to operate in a first band around 800 MHz and a second band around 1.8 GHz to 1.9 GHz. To this end, the lengths of the curvilinear radiative elements 162-164 can be as to tune the antenna to a frequency of 800 MHz. Accordingly, the first curvilinear element 162 can have a length of approximately 4 inches, the second curvilinear element 163 can have a length of approximately 4.13 inches, and the third curvilinear element 214 can have a length of approximately 3.44 inches. The height of each of the second ends 172-174 of the curvilinear elements 162-164 above the ground reference 156 can range around one-quarter of a wavelength corresponding to a frequency of 1.8 GHz. It has been determined in implementing the illustrated antenna that a height of approximately 1.75 inches for the second ends 172-174 of the curvilinear elements 162-164 allows for operation in the 1.8 GHz-1.9 GHz band.

Figure 9:
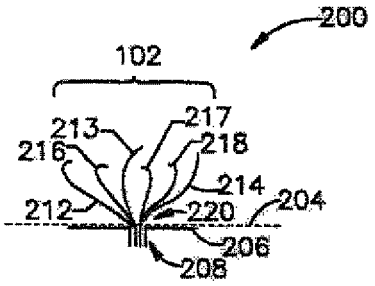
FIG. 9 illustrates a side view of a fourth exemplary implementation of an antenna assembly in accordance with an aspect of the present invention.

FIG. 9 illustrates a side view of a fourth exemplary implementation of an antenna assembly 200 in accordance with an aspect of the present invention. The illustrated antenna assembly 200 comprises a driven antenna assembly 202 located on a first side of an imaginary plane 204, and a ground reference 206 located at the imaginary plane or on a second side of the imaginary plane. The driven antenna assembly 202 can be driven by an antenna feed that is electrically connected to the driven antenna assembly approximately at the imaginary plane 204. In the illustrated implementation, the ground reference 206 is illustrated as planar, but it will be appreciated that other configurations of the ground plane can be utilized within the illustrated antenna assembly. The ground reference 206 may be comprised of any appropriate electrically conductive material such as, for example, copper or stainless steel. The antenna feed 208 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 202 and allows a ground braid of the coaxial cable to electrically connect to the ground reference 206. A dielectric material can be used to electrically insulate the center conductor and the driven antenna assembly 202 from the ground reference 206.

The driven antenna assembly 202 comprises a first set of three radiative elements 212-214 and a second set of radiative elements 216-218 that spiral outward from a common apex 220. It will be appreciated, however, that one element, two elements, or more than three elements can also be utilized in each set. The driven antenna assembly 202 and its constituent elements 212-214 and 216-218 are formed from a conductive material. The radiative elements 212-214 and 216-218 are electrically connected to the antenna feed 208 and one another at respective first ends at the apex 220. Each of the radiative elements 212-214 and 216-218 are curvilinear and radiate away from the apex 220. In the illustrated implementation, the curvilinear elements extend away from the apex 220 near a desired horizontal radius from the apex at a first rate of ascent, and tend proceed at a second rate of ascent, greater than the first rate of ascent. In the illustrated implementation, this is accomplished without any change to the sign of the curvature; the direction of concavity of the element does not change. Accordingly, the maximum horizontal extent of the curvilinear elements, and thus, the radius of the ground reference 206, can be limited without a significant loss of sensitivity in the lower frequency portion of the band. It will be appreciated, however, that due to the curvature of the curvilinear elements, the height of the curvilinear elements will also be limited, lowering the overall profile of the antenna assembly.

In the illustrated implementation, the first, second, and third radiative elements 212-214 are oriented such that the first, second, and third elements are spaced evenly as they leave the apex 220, that is, at intervals of one-hundred and twenty degrees. The fourth, fifth, and sixth radiative elements 216-218 are oriented such that they are spaced evenly between the first set of radiative elements 212-214, such that each of the second set of radiative elements is spaced at sixty degree intervals from two of the first set of radiative elements as they leave the apex and at intervals of one-hundred and twenty degrees from one another.

Each of the first set of radiative elements 212-214 has a length within a first range of lengths associated with a first characteristic frequency. It will be appreciated that by "length," reference the actual or straightened length of the curvilinear element is intended. A first element 212 can have a length, $L_1$, tuned to be receptive to the first characteristic frequency and each of the second and third elements 213 and 214 can have a length within an approximately ten percent variance of the length of the first element. Varying the lengths of the first set of radiative elements 212-214 can provide an improvement in the broadband properties of the driven antenna assembly, but it will be appreciated that a common antenna length, for example, the tuned antenna length $L_1$, can be utilized for the first set of radiative elements in while still maintain the enhanced band properties of the antenna. Each of the second set of radiative elements 216-218 have a length in a second range around a length of approximately four-fifths the tuned length associated with the characteristic frequency. In one implementation, the length of each of the second set of radiative elements 216-218 can be equal to four-fifths the length of a corresponding one of the first set of radiative elements 212-214.

In the illustrated implementation, the antenna assembly 100 is designed to operate band of frequencies ranging from around 700 MHz to around 6 GHz continuously. To this end, the first curvilinear element 212 can have a length of approximately 4.25 inches, the second curvilinear element 213 can have a length of approximately 4.5 inches, and the third curvilinear element 214 can have a length of approximately 4 inches. The maximum height of each of the of the first set of curvilinear elements 212-214 above the ground reference 206 can be limited to approximately 2.5 inches. The lengths of the second set of radiative elements 216-218 can be cut to approximately four-fifths the length of the first set of radiative elements 212-214. Accordingly, the fourth radiative element 216 can have a length of around 3.5 inches, the fifth radiative element 217 can have a length on the order of 3.75 inches, and the sixth radiative element 218 can have a length of approximately 3.25 inches. Each element 212-214 and 216-218 can have a diameter of approximately one-sixteenth of an inch.

Figure 10:
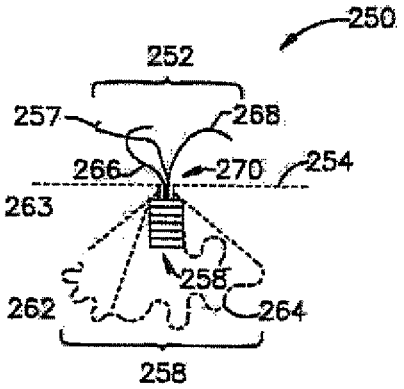
FIG. 10 illustrates a side view of a fifth exemplary implementation of an antenna assembly in accordance with an aspect of the present invention.

FIG. 10 illustrates a side view of a fifth exemplary implementation of an antenna assembly 250 in accordance with an aspect of the present invention. The illustrated antenna assembly 250 comprises a driven antenna assembly 252 located on a first side of an imaginary plane 254, and a ground reference 256. The driven antenna assembly 252 can be driven by an antenna feed 258 that is electrically connected to the driven antenna assembly approximately at the imaginary plane 254. The ground reference 256 may be comprised of any appropriate electrically conductive material such as, for example, copper or stainless steel.

In the illustrated implementation, the ground reference 256 is implemented as a series of curvilinear ground elements 262-264 that extend along the second side of the imaginary plane 254 to form an outline of a conical structure having a crenellated edge. Each of the curvilinear ground elements 262-264 can have a substantially linear portion that extends from a shield portion of the antenna feed 258 at an acute angle relative to the imaginary plane 254. In general, the acute angle between each of the curvilinear ground elements 262-264 and the imaginary plane 254 will be between forty-five degrees and seventy degrees, and in the illustrated implementation, each curvilinear ground element forms a sixty degree angle with the imaginary plane. A crenellated portion of each of the curvilinear ground elements 262-264 can run substantially parallel to the imaginary plane as to form at least a portion of an elliptical or circular outline in a plane parallel to the imaginary plane.

The antenna feed 258 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 252 and allows a ground braid, or shield portion, of the coaxial cable to electrically connect to each of the discrete curvilinear elements comprising the ground reference 256. A dielectric material can be used to electrically insulate the center conductor and the driven antenna assembly 252 from the ground reference 256.

The driven antenna assembly 252 comprises a set of curvilinear radiative antenna elements 266-268 that spiral outward from a common apex 270. It will be appreciated, however, that one element, two elements, or more than three elements can also be utilized in each set. The driven antenna assembly 252 and its constituent elements 266-268 are formed from a conductive material. The radiative elements 266-268 are electrically connected to the antenna feed 258 and one another at respective first ends at the apex 270. Each of the radiative elements 266-268 are curvilinear and radiate away from the apex 270. In the illustrated implementation, the curvilinear elements extend away from the apex 270 near a desired horizontal radius from the apex at a first rate of ascent, and then proceed at a second rate of ascent that is less than the first rate of ascent. It will be appreciated, however, that in other implementations, the second rate of ascent can be greater than the first rate of ascent. Accordingly, the maximum vertical extent of the curvilinear elements 266-268, and thus the vertical profile of the antenna assembly 250, can be limited without a significant loss of sensitivity in the lower frequency portion of the band. The vertical profile and ground plane radius of the assembly can be further reduced through use of the discrete curvilinear ground elements 262-264, greatly reducing the amount of space necessary to implement the antenna assembly.

In the illustrated implementation, the curvilinear ground elements 262-264 are oriented such that respective first, second, and third elements are spaced evenly as they leave the shield portion of the antenna feed, that is, at intervals of one-hundred and twenty degrees. The respective first, second, and third radiative elements 266-268 are oriented such that they are spaced evenly as they leave the apex, at intervals of one-hundred and twenty degrees. Each of the set of curvilinear ground elements 262-264 has a length within a first range of lengths associated with a first characteristic frequency. It will be appreciated that by "length," reference the actual or straightened length of the curvilinear element is intended. A first curvilinear ground element 262 can have a length, $L_1$, the second and third curvilinear ground elements 263 and 264 can have a length within an approximately ten percent variance of the length of the first element. Varying the lengths of the curvilinear ground elements 262-264 can provide an improvement in the broadband properties of the antenna assembly, but it will be appreciated that a common antenna length, for example, $L_1$, can be utilized while still maintaining the enhanced band properties of the device.

Each of the radiative elements 266-268 have a length within a second range of lengths associated with a second characteristic frequency. For example, the First radiative element 266 can have a length, $L_2$, tuned to be receptive to the second characteristic frequency and each of the second and third radiative elements 267 and 268 can have a length within an approximately ten percent variance of the length of the first element. In one implementation, the antenna assembly 250 is designed to operate the three ISM bands of radio frequencies, including a first frequency band around 912-928 MHz, a second frequency band around 2.4 GHz, and a third frequency band around 5-6 GHz. The three curvilinear ground elements can be cut to lengths associated with the first and lowest frequency band, such that the first curvilinear ground element 262 can have a length of approximately 5.81 inches, the second curvilinear ground element 263 can have a length of approximately 5.63 inches, and the third curvilinear ground element 264 can have a length of approximately 6 inches. The lengths of the second set of radiative elements 266-268 can be cut to tune the antenna to the second frequency band, such that the first radiative element 266 can have a length of approximately 0.81 inches, the second radiative element 267 can have a length of approximately 0.69 inches, and the third radiative element 268 can have a length of approximately 0.94 inches. Capacitive and inductive interaction among the various elements 262-264 and 266-268 increase the sensitivity of the antenna 250 in the third frequency band. Each of the radiative elements 266-268 can have a diameter of approximately one-sixteenth of an inch.

Figure 11:
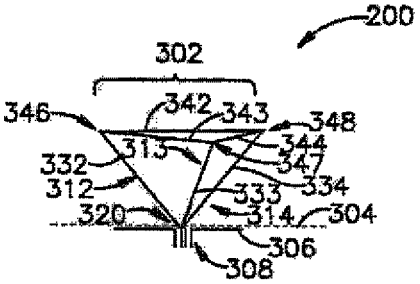
FIG. 11 illustrates a side view of a sixth exemplary implementation of an antenna assembly in accordance with an aspect of the present invention.

FIG. 11 illustrates a sixth exemplary implementation of an antenna assembly 300 in accordance with an aspect of the present invention. The illustrated antenna assembly 300 comprises a driven antenna assembly 302 located on a first side of an imaginary plane 304, and a ground reference 306 located at the imaginary plane or on a second side of the imaginary plane. In the illustrated implementation, the ground reference 306 is illustrated as planar, but it will be appreciated that other configurations of the ground plane can be utilized within the illustrated antenna assembly. The driven antenna assembly 302 can be driven by an antenna feed that is electrically connected to the driven antenna assembly approximately at the imaginary plane 304.

The antenna feed 308 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 302 and allows a ground braid of the coaxial cable to electrically connect to the ground reference 306. A dielectric material can be used to electrically insulate the center conductor and the driven antenna assembly 302 from the ground reference 306.

The driven antenna assembly 302 comprises three radiative elements 312-314 that extend outward from a common apex 320. The driven antenna assembly 302 and its constituent elements 312-314 are formed from a conductive material. The radiative elements 312-314 are electrically connected to the antenna feed 308 and one another at respective first ends at the apex 320. The radiative elements 312-314 comprise respective first linear segments 332-334 that extend away from the apex 320 at an acute angle relative to the imaginary plane 304, and respective second linear segments 342-344 that extend in a direction substantially parallel to the imaginary plane. Each first segment 332-334 is connected to its associated second segment 342-344 at an acute angle at a vertex 346-348. In accordance with an aspect of the invention, each second linear segment 342-344 can extend from their associated vertex 346-348 to the vertex of another radiative element 312-314, such that each radiative element has a second end terminating on the vertex of another radiative element, forming the outline of an inverted pyramid. By bending the radiative elements 312-314 into the illustrated pyramidal shape in this manner, an additional degree of capacitive and inductive coupling is provided such that the pyramidal shape allows for a significant reduction in the vertical profile of the antenna 300.

Figure 12:
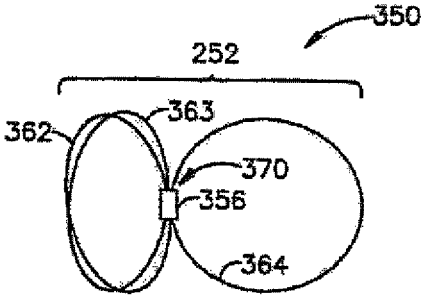
FIG. 12 illustrates a side view of a seventh exemplary implementation of an antenna assembly in accordance with an aspect of the present invention.

FIG. 12 illustrates a seventh exemplary implementation of an antenna assembly 350 in accordance with an aspect of the present invention. The illustrated antenna assembly 350 comprises a driven antenna assembly 352 and an SMA connector 356 having a center lead and a shield element that serves as a ground reference. The driven antenna assembly 352 comprises three radiative elements 362-364 that extend outward from a common apex 370. The driven antenna assembly 352 and its constituent elements 362-364 are formed from a conductive material. The radiative elements 362-364 are electrically connected to the center lead 358 and one another at respective first ends at the apex 370. The radiative elements 362-364 comprise elliptical loops that extend away from the apex 370 and loop back to terminate on the shield element of the SMA connector 356. The radiative elements 362-364 are generally substantially circular, but can be compressed to reduce the horizontal footprint of the antenna. In accordance with an aspect of the invention, the antenna assembly 350 is designed with a characteristic lower bound frequency, and each radiative element 362-364 has a length approximately equal to a wavelength associated with the characteristic lower bound frequency. In the illustrated example, the characteristic lower bound frequency is around 300 MHz, and the length of each radiative element 362-364 is approximately 40 inches, allowing the antenna 350 to be sensitive across at least dual frequency bands of 310-325 MHz and 915-917 MHz.

Figure 13:
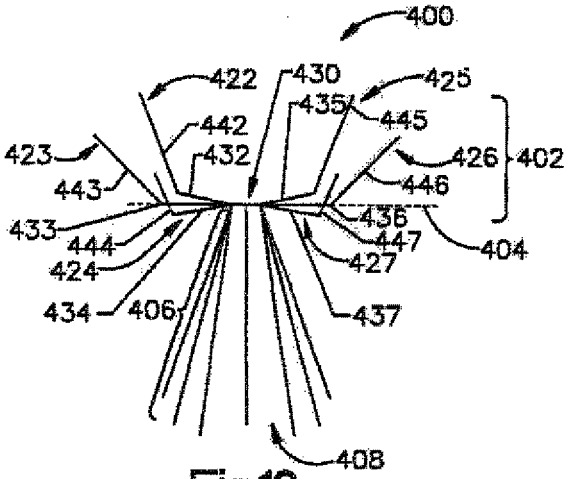
FIG. 13 illustrates a perspective view of an eighth exemplary implementation of an antenna assembly in accordance with an aspect of the present invention.

FIG. 13 illustrates an eighth exemplary implementation of an antenna assembly 400 in accordance with an aspect of the present invention. The illustrated antenna assembly 400 comprises a driven antenna assembly 402 located on a first side of an imaginary plane 404, and a ground reference 406 located at the imaginary plane or on a second side of the imaginary plane. The driven antenna assembly 402 can be driven by an antenna feed 408 that is electrically connected to the driven antenna assembly approximately at the imaginary plane 404. The antenna feed 408 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 402 and allows a ground braid of the coaxial cable to electrically connect to the ground reference 406. A dielectric material can be used to electrically insulate the center conductor and the driven antenna assembly 402 from the ground reference 406.

In the illustrated implementation, the ground reference 406 comprises a plurality of conductive members that extend downward from the antenna feed 408 at an acute angle relative to the imaginary plane. It will be appreciated that in place of the plurality of conductive members, a single solid or mesh cone can be used. In the illustrated implementation, the angle between the conductive members and the imaginary plane 404 can be approximately sixty degrees, and the length of each member is approximately one quarter of a wavelength of the lowest operating frequency of the antenna. For example, the illustrated antenna wideband configuration is configured to operate at a frequency range between eighty-eight megahertz and six gigahertz with a standing wave ratio of less than two to one, with each of the conductive members between two to three feet in length.

The driven antenna assembly 402 comprises six radiative elements 422-427 that extend outwardly from a common apex 430 located approximately within the imaginary plane 404. The driven antenna assembly 402 and its constituent elements 422-427 are formed from a conductive material. The radiative elements 422-427 are electrically connected to the antenna feed 408 and to one another at respective first ends at the apex 430. Each radiative element 422-427 can comprise a first linear segment 432-437 that connects to the apex 430 at a first end and extends parallel to the imaginary plane 404 to a second end. In the illustrated example, each of the first linear segments 432-437 have an identical length of approximately one-sixteenth of the wavelength associated with the lowest operating frequency, or approximately eight inches. Each of the radiative elements 422-427 further comprise a second linear segment 442-447 that extends from the second end of the first portion at an angle acute to the imaginary plane 404 to terminate at a point on the first side of the imaginary plane. In accordance with an aspect of the invention, the second linear segments 442-447 of the radiative element 422-427 can vary in total length, such that a shortest of the radiative elements 422 has a total (i.e., straightened) length of approximately one tenth of the wavelength associated with the lowest operating frequency and a longest of the radiative elements 427 has a total length of approximately one quarter of the wavelength associated with the lowest operating frequency of the antenna. In an alternative implementation, each radiative element 422-427 can comprise a third linear segment (not shown) that connects a terminal point of the second linear segment 442-447 of each radiative element to the apex 430. In another implementation, an outline formed by the first, second, and third radiative members can be filled with a wire mesh or solid conductive plate to enhance the wideband characteristics of the antenna 400.

Figure 14:
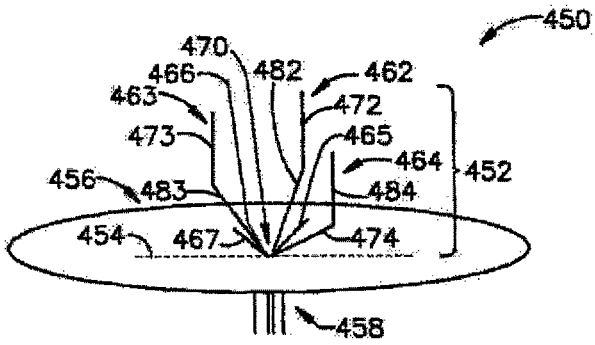
FIG. 14 illustrates a perspective view of a ninth exemplary implementation of an antenna assembly in accordance with an aspect of the present invention.

FIG. 14 illustrates a ninth exemplary implementation of an antenna assembly 450 in accordance with an aspect of the present invention. The illustrated antenna assembly 450 comprises a driven antenna assembly 452 located on a first side of an imaginary plane 454, and a ground reference 456 located at the imaginary plane or on a second side of the imaginary plane. In the illustrated implementation, the ground reference 456 is illustrated as planar, but it will be appreciated that other configurations of the ground plane can be utilized within the illustrated antenna assembly. The driven antenna assembly 452 can be driven by an antenna feed 458 that is electrically connected to the driven antenna assembly approximately at the imaginary plane 454. The antenna feed 458 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 452 and allows a ground braid of the coaxial cable to electrically connect to the ground reference 456. A dielectric material can be used to electrically insulate the center conductor and the driven antenna assembly 452 from the ground reference 456.

The driven antenna assembly 452 comprises six radiative elements 462-467 that extend outwardly from a common apex 470 located approximately within the imaginary plane 454. The driven antenna assembly 452 and its constituent elements 462-467 are formed from a conductive material. The radiative elements 462-467 are electrically connected to the antenna feed 460 and to one another at respective first ends at the apex 470. A first set of radiative elements, comprising first, second, and third radiative elements 462-464, have respective first linear segments 472-474 that extend from respective first ends at the apex 480 at an acute angle relative to the imaginary plane 454 to respective second ends on the first side of the imaginary plane. Each of the first linear segments 472-474 associated with the first, second, and third radiative antenna elements 462-464 may be at a unique acute angle or at the same acute angle relative to the imaginary plane 454. In the illustrated implementation, the first, second, and third radiative elements 462-464 are oriented such that the first, second, and third elements are spaced evenly, that is, at intervals of one-hundred and twenty degrees. Each of the first set of radiative elements 462-464 further comprise respective second linear segments 482-484 that extend from the respective second ends of the first set of linear elements 462-464 in a direction perpendicular to and away from the imaginary plane 454.

Each of the first linear segments 462-464 can have a total length within a first range of lengths associated with a characteristic lower bound frequency. For example, a first element 472 can have a length, $L_1$, tuned to be receptive to the characteristic lower bound frequency and each of the second and third elements 463 and 464 can have a length within an approximately ten percent variance of the length of the first element. In one implementation, in which the antenna assembly 450 is configured to operate at frequencies between one hundred twenty-six megahertz and six gigahertz, the first linear segments 472-474 can have lengths of approximately six inches, and the second linear segments 482-484 can have lengths of eight and three-quarter inches, eleven inches, and twelve and three-quarters, respectively, giving the first set of radiative elements 462-464 total lengths of fourteen and three-quarters inches, seventeen inches, and eighteen and three-quarters inches. Varying the lengths of the first set of radiative elements 462-464 can provide an improvement in the broadband properties of the driven antenna assembly, but it will be appreciated that a common antenna length, for example, the tuned antenna length $L_1$, can be utilized for the first set of radiative elements in while still maintaining the wideband properties of the antenna.

A second set of radiative elements comprise fourth, fifth, and sixth radiative elements 465-467 that are generally linear and extend away from the apex 470 at an acute angle relative to the imaginary plane 454. Each of the fourth, fifth, and sixth radiative antenna elements 465-467 may be at a unique acute angle or at the same acute angle relative to the imaginary plane 454 as one another or one of the first set of radiative elements 462-464. In the illustrated implementation, the fourth, fifth, and sixth radiative elements 465-467 are oriented such that they are spaced evenly between the first set of radiative elements 462-464, such that each of the second set of radiative elements is spaced at sixty degree intervals from two of the first set of radiative elements and at intervals of one-hundred and twenty degrees from one another. In one implementation, each of the second set of radiative elements 466-468 has a length in a second range around a length of approximately ninety-five percent of a total (i.e., straightened) length associated a corresponding element in the first set of radiative elements 462-464.

In an alternative implementation, each of the first set of radiative elements 462-464 can comprise a third linear segment (not shown) that connects a terminal point of the second linear segment 482-484 of each radiative element to the apex 470. In another implementation, an outline formed by the first, second, and third radiative members can be filled with a wire mesh or solid conductive plate to enhance the wideband characteristics of the antenna assembly 450.

Figure 15:
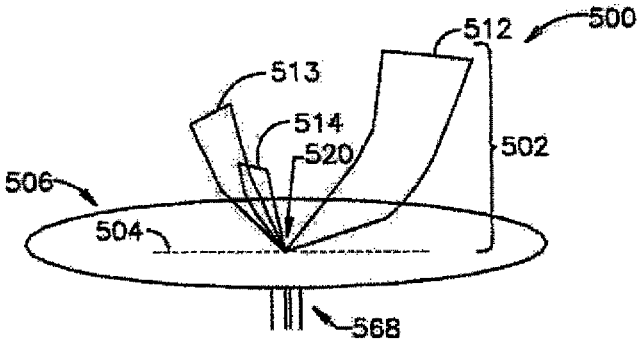
FIG. 15 illustrates a perspective view of a tenth exemplary implementation of an antenna assembly in accordance with an aspect of the present invention.

FIG. 15 illustrates a tenth exemplary implementation of an antenna assembly 500 in accordance with an aspect of the present invention. The illustrated antenna assembly 500 comprises a driven antenna assembly 502 located on a first side of an imaginary plane 504, and a ground reference 506 located at the imaginary plane or on a second side of the imaginary plane. In the illustrated implementation, the ground reference 506 is illustrated as planar, but it will be appreciated that other configurations of the ground plane can be utilized within the illustrated antenna assembly. The driven antenna assembly 502 can be driven by an antenna feed 508 that is electrically connected to the driven antenna assembly approximately at the imaginary plane 504. The antenna feed 508 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 502 and allows a ground braid of the coaxial cable to electrically connect to the ground reference 506. A dielectric material can be used to electrically insulate the center conductor and the driven antenna assembly 502 from the ground reference 506.

The driven antenna assembly 502 comprises three radiative elements 512-514 that extend outwardly from a common apex 520 located approximately within the imaginary plane 504. Each radiative element 512-514 comprises a three-sided loop of a conductive material, with each side comprising a curvilinear segment. In the illustrated implementation, one segment of the loop is substantially linear and substantially parallel to the imaginary plane 504, such that the segment is substantially perpendicular to a first axis defined to be coincident with the antenna feed 508. The radiative elements 512-514 narrow to a point at the apex 520 and broaden to a maximum width at a point farthest from the apex 520. In the illustrated implementation, each radiative element 512-514 is curved, such that the angle of the radiative member relative to the imaginary plane 504 increases with the distance from the apex 520. In the illustrated implementation, the radiative elements 512-514 each form an angle relative to the imaginary plane 504 of approximately thirty degrees at the apex, and curve to an angle of approximately sixty degrees relative to the imaginary plane at the farthest point from the apex. It will be appreciated that the length and maximum width of the radiative elements can vary with the implementation and the desired frequency coverage. In the illustrated configuration, the antenna can be configured to operate within a range of 2 GHz to 11 GHz with a standing wave ratio of less than two to one, with a shortest radiative element 514 having a length of approximately one inch, a longest radiative element 512 having a length of approximately one and one-quarter inch, and a remaining radiative element 513 having a length of approximately one and one-eighth inch. Each element 512-514 can have a maximum width approximately equal to one third of its associated length. In one implementation, an outline formed by the first, second, and third radiative members can be filled with a wire mesh or solid conductive plate to enhance the wideband characteristics of the antenna assembly 500. It will be appreciated that the associated sidelength of each of the radiative members 512-514 may vary, and additional shapes for the radiative elements can be utilized. For example, in one implementation, one corner of each radiative element 512-514 can be truncated to provide a four-sided loop.

Figure 16:
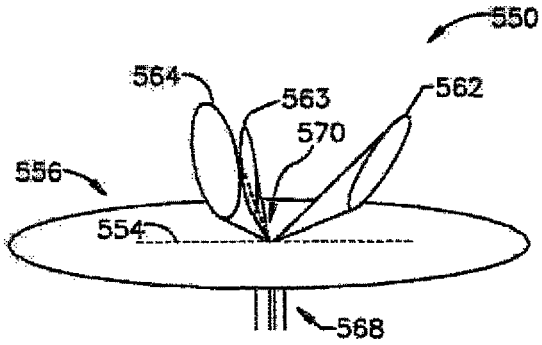
FIG. 16 illustrates a perspective view of an eleventh exemplary implementation of an antenna assembly in accordance with an aspect of the present invention.

FIG. 16 illustrates an eleventh exemplary implementation of an antenna assembly 550 in accordance with an aspect of the present invention. The illustrated antenna assembly 550 comprises a driven antenna assembly 552 located on a first side of an imaginary plane 554, and a ground reference 556 located at the imaginary plane or on a second side of the imaginary plane. The driven antenna assembly 552 can be driven by an antenna feed 558 that is electrically connected to the driven antenna assembly approximately at the imaginary plane 554. The antenna feed 558 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect the driven antenna assembly 552 and allows a ground braid of the coaxial cable to electrically connect to the ground reference 556. A dielectric material can be used to electrically insulate the center conductor and the driven antenna assembly 552 from the ground reference 556.

The driven antenna assembly 552 comprises three radiative elements 562-564 that extend from a common apex 570. It will be appreciated, however, that the antenna assembly can include more than three radiative elements, configured in a manner consistent with the example assembly 550. Each radiative element 562-564 comprises an oblique, elliptical cone having an open base. The sides of each radiative element 562-564 are formed from a conductive material, which can be either solid or formed from a mesh of appropriate size for the operating frequency of the antenna. The radiative elements 562-564 can be configured to meet at their respective apices at the common apex 570. In the illustrated configuration, the antenna can be configured to operate within a range of 2 GHz to 11 GHz with a standing wave ratio of less than two to one. Measuring along a line between an apex and point on the base of the cone along a semi-major axis of the elliptical base that is closest to the imaginary plane 554, with a shortest radiative element 562 having a length of approximately five-sixteenths of an inch, a longest radiative element 564 having a length of approximately seven-sixteenths of an inch, and a remaining radiative element 563 having a length of approximately three-eighths of an inch. Measuring along a line between an apex and point on the base of the cone along a semi-major axis of the elliptical base that is farthest from the imaginary plane 554, with a shortest radiative element 562 having a length of approximately seven-eighths of an inch, a longest radiative element 564 having a length of approximately one and five-sixteenths inches, and a remaining radiative element 563 having a length of approximately one and one-eighth inches. The angle formed between the imaginary plane 554 and a line between an apex and point on the base of the cone along a semi-major axis of the elliptical base that is closest to the imaginary plane can vary with an implementation of the ground reference, and can range between zero and forty-five degrees.

In the illustrated implementation, the ground reference 556 is illustrated as planar, but it will be appreciated that other configurations of the ground plane can be utilized within the illustrated antenna assembly. For example, the planar ground reference 556 of the illustrated implementation can be utilized to obtain a near hemispherical antenna pattern for omni-directional transmission and reception from a position near the ground. The planar ground reference 556 can have a diameter of approximately one quarter of a wavelength of a lowest operating frequency of the antenna assembly 550. Alternatively, the antenna assembly can include a conical ground reference that slopes away from the imaginary plane 554 at an angle of approximately forty-five degrees relative to the imaginary plane. The conical ground reference can be utilized to provide a near spherical antenna pattern. In an exemplary implementation, the sidelength of the cone can be approximately one-quarter of a wavelength associated with a lowest operating frequency of the antenna assembly. In another implementation, the ground reference can comprise a shallow conical structure that slopes away from the imaginary plane 554 at an angle of approximately 22.5 degrees relative to the imaginary plane. The sidelength of the cone can be approximately 2.5 times the wavelength associated with a lowest operating frequency of the antenna assembly 550. The shallow cone ground plane can be utilized where a high gain omni-directional assembly is required. For example, at the horizon (i.e., along the imaginary plane 554), a gain of 7 dBi can be achieved.

Figure 17:
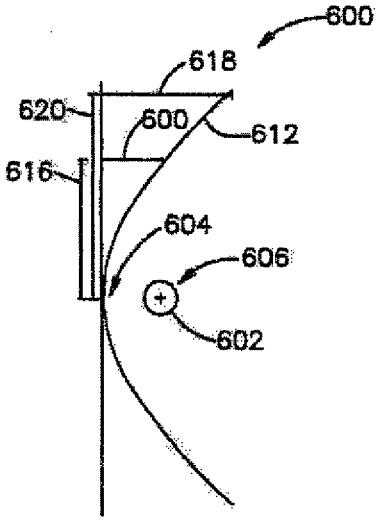
FIG. 17 illustrates a cross sectional view of a parabolic reflector dish for directing radiation received at and transmitted from an omni-directional enhanced band antenna to provide directionality to the antenna in accordance with an aspect of the present invention.

FIG. 17 illustrates a cross-sectional view of a parabolic reflector dish 700 for directing radiation received at and transmitted from an omni-directional enhanced band antenna 702 to provide directionality to the antenna in accordance with an aspect of the present invention. The parabolic reflector dish 700 is formed from a conductive material and shaped as a circular paraboloid that can be represented by the revolution of a parabola around its axis, wherein the parabola having dimensions as described herein, can be described by the formula:

$$y = \frac{x^2}{24} \qquad \text{Eq. 1}$$

The cross-sectional view represents a center plane in the parabolic reflector 700, wherein the center plane is a plane that encompasses an apex 704 of the parabolic reflector and a focal point 706 of the parabolic reflector. It will be appreciated that while there are a number of planes that encompass these two points, the parabolic reflector 700 is a circular paraboloid, and thus all of these planes will produce substantially identical cross-sectional views. In the cross sectional plane, a horizontal axis represents the y variable and a vertical axis represents the x variable, with the origin at the apex 704 of the parabolic reflector 700.

In accordance with an aspect of the present invention, the parabolic reflector dish 700 is configured such that the focal depth 708 of the dish is well within a volume defined by the dish. For example, the parabolic reflector dish 700 can be continued past the focal point 706 to a point where a line tangent to the edge 712 of the dish forms an angle between fifty-five and sixty degrees with an axis of dish. By configuring the dish to have a focal point within the volume of the dish, significant electromagnetic energy that might otherwise escape around the edge 712 of the dish is redirected along the axis of the dish. Accordingly, the directionality, and corresponding gain, of the enhanced band antenna 702 located at the focal point 706 of the dish 700 can be significantly increased, providing, in contrast to prior designs, a high-gain dish antenna with extremely high data throughput over an unprecedented frequency range (e.g., nine gigahertz).

In the illustrated implementation, the parabolic reflector 700 is configured for a wide band antenna 702 sensitive to a frequency band between 2 GHz and 11 GHz. In one implementation, an antenna similar to that illustrated in FIG. 16 with a conical ground reference can be utilized. The focal point 706 of the dish is located at point six inches from the apex. The parabolic reflector dish 700 has a focal point radius 716 of twelve inches. The dish has a depth 718 of thirteen and one-half inches, and a maximum radius 720 of eighteen inches. Using the illustrated parabolic reflector dish, a gain of the order of 25-35 dBi can be realized.

Figure 18:
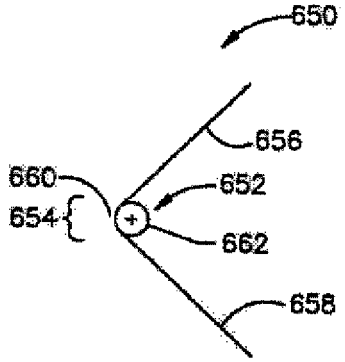
FIG. 18 illustrates a cross sectional view of a folded sheet reflector for providing directionality to an omni-directional enhanced band antenna assembly in accordance with an aspect of the present invention.

FIG. 18 illustrates a cross-sectional view of a folded sheet reflector 750 for providing directionality to an omni-directional enhanced band antenna assembly 752 in accordance with an aspect of the present invention. The folded sheet reflector 750 is folded along a vertex 754 and extends from the vertex in two substantially planar conductive members 756 and 758. In the illustrated implementation, the folded sheet reflector 750 is folded at an angle of approximately ninety degrees at the vertex 754 and each planar is substantially rectangular, extending to a length of twelve inches with a width of seven inches. In accordance with an aspect of the present invention, the antenna assembly 752 is placed immediately adjacent to a center point 760 of the vertex, such that a ground reference 762 of the antenna is physically and electrically connected to the folded sheet reflector 750. It will be appreciated that the planar members 756 and 758 can be slightly deformed near the vertex to accommodate the antenna assembly 752. This electrical connection between the ground reference 762 and the folded sheet 750 substantially mitigates the effects of any mismatch in impedance at the antenna assembly, allowing for significant increase of the directionality, and corresponding gain, of the enhanced band antenna 752, greatly enhancing the utility of the antenna for point-to-point communications. Using the illustrated folded sheet reflector 750, a gain of the order of 10 dBi can be realized.

Figure 19:
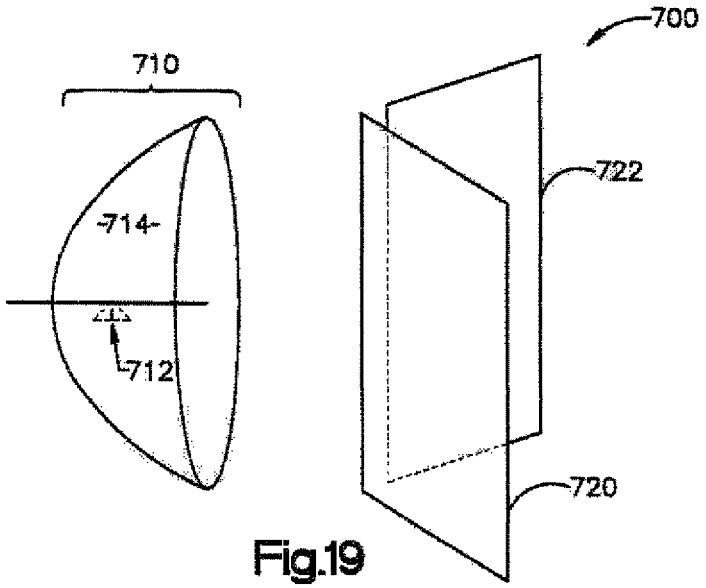
FIG. 19 illustrates a perspective view of a sector antenna arrangement in accordance with an aspect of the present invention

FIG. 19 illustrates a sector antenna arrangement 800 in accordance with an aspect of the present invention. The sector arrangement 800 comprises a directional antenna arrangement 810 comprising a reflective dish 812 and an omni-directional antenna arrangement 814. In the illustrated implementation, the reflector dish 812 can comprise a parabolic reflector dish similar to the parabolic reflector dish illustrated in FIG. 17 with a maximum radius of nine inches, a focal point of the dish is located at point two inches from the apex, a focal point radius of four inches, and a depth of approximately ten inches. The omni-directional antenna arrangement can comprise an omni-direction antenna arrangement an antenna similar to that illustrated in FIG. 16 with a conical ground reference.

First and second planar conductive members 820 and 822 can be positioned forward of the parabolic reflector dish at an oblique angle relative to the axis of the parabolic reflector dish 812. In the illustrated implementation, the first planar conductive member 820 is positioned such that a first edge, closest to the parabolic reflector dish 812, is positioned forward of the parabolic reflector dish and to a first side of the apex, and the second planar conductive member 822 is positioned such that a first edge, closest to the parabolic reflector dish, is positioned forward of the parabolic reflector dish and to a second side of the apex of the dish. The respective first edges of each of the first and second planar conductive members 820 and 822 at a distance equal to two-thirds of the maximum diameter of the dish. The width of each conductive planar member 820 and 822 can equal to two-thirds of the maximum diameter of the dish, with a gap between the two planar members equal to one-third of the maximum diameter of the dish.

The angle at which the first and second planar conductive members 820 and 822 are positioned relative to the axis of the parabolic reflector dish 812 can be varied to control the arc encompassed by the sector antenna arrangement 800, such that the arc encompassed by the sector antenna can be increased at a cost to the gain of the antenna. For example, where the conductive members 820 and 822 are aligned at 7.5 degrees from the axis of the parabolic reflector dish, the sector antenna arrangement 800 encompasses thirty degrees with a gain at 2.4 gigahertz at 15 dBi, and 19 dBi at six gigahertz. Where the conductive members 820 and 822 are aligned at thirty degrees from the axis of the parabolic reflector dish, the sector antenna arrangement 800 encompasses one hundred twenty degrees with a gain at 2.4 gigahertz at 10 dBi, and 13 dBi at six gigahertz. It will be appreciated, however, due to the multipolarized properties of the omni-directional antenna arrangement 814, the actual performance of the antenna will be significantly better than expected for the gain values given above through obstructions and fluctuating air medium. Further, it will be appreciated that the dimensions of the sector antenna arrangement 800 can be scaled to provide a higher gain at the cost of an increased size of the sector antenna arrangement. The spacing of the various elements comprising the sector antenna arrangement and the size of the planar conductive members 820 and 822 will vary with the size of the parabolic reflector dish 812.

Figure 20:
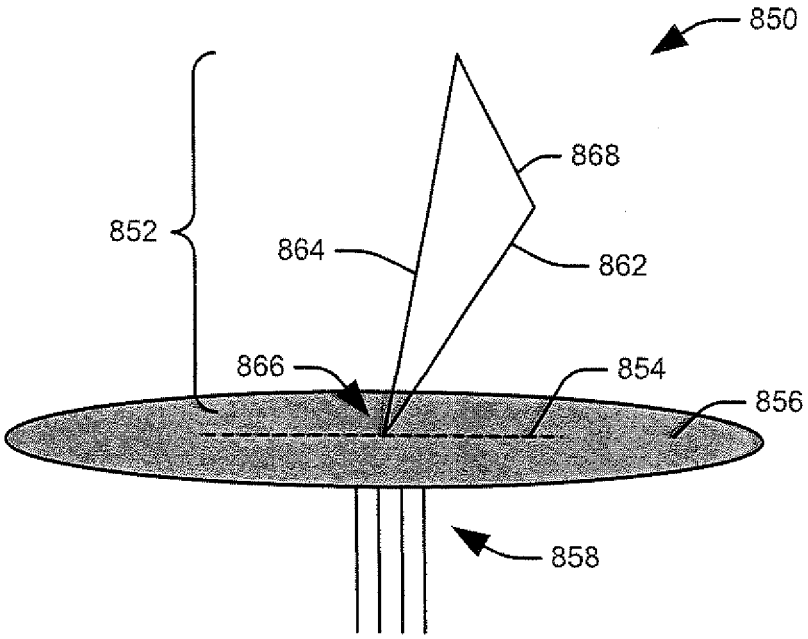
FIG. 20 illustrates a perspective view of a twelfth exemplary implementation of an antenna assembly in accordance with an aspect of the present invention.

FIG. 20 illustrates a twelfth exemplary implementation of an antenna assembly 850 in accordance with an aspect of the present invention. The illustrated antenna assembly 850 comprises a driven antenna assembly 852 located on a first side of an imaginary plane 854, and a ground reference 856 located at the imaginary plane or on a second side of the imaginary plane. In the illustrated implementation, the ground reference 856 is illustrated as planar, but it will be appreciated that other configurations of the ground plane can be utilized within the illustrated antenna assembly. The driven antenna assembly 852 can be driven by an antenna feed 858, such as SMA (or similar) coaxial connector, that is electrically connected to the driven antenna assembly approximately at the imaginary plane 854 to connect the antenna to an associated transceiver system (not shown).

The driven antenna assembly 852 comprises two radiative elements 862 and 864 that extend outwardly from a first apex 866 located approximately within the imaginary plane 854, and a third radiative element 868 that connects the first and second radiative elements 862 and 864 at their distal ends to form a closed loop. It will be appreciated that the lengths of the radiative elements 862, 864, and 868 and the angles formed between the radiative elements can vary with the implementation. In one implementation, in which the antenna operates at frequencies between 2.4 and 6 GHz, the first radiative element can have a length on the order of a quarter of an inch, the second radiative element can have a length on the order of three quarters of an inch, and an angle between the first and second radiative elements can be approximately fifteen degrees. The driven antenna assembly 852 and its constituent elements 862, 864, and 868 are formed from a conductive material. In one implementation, the loop formed by the first, second, and third radiative members 862, 864, and 868 can be filled with a wire mesh or solid conductive plate to enhance the wideband characteristics of the antenna assembly 850.

Figure 21:
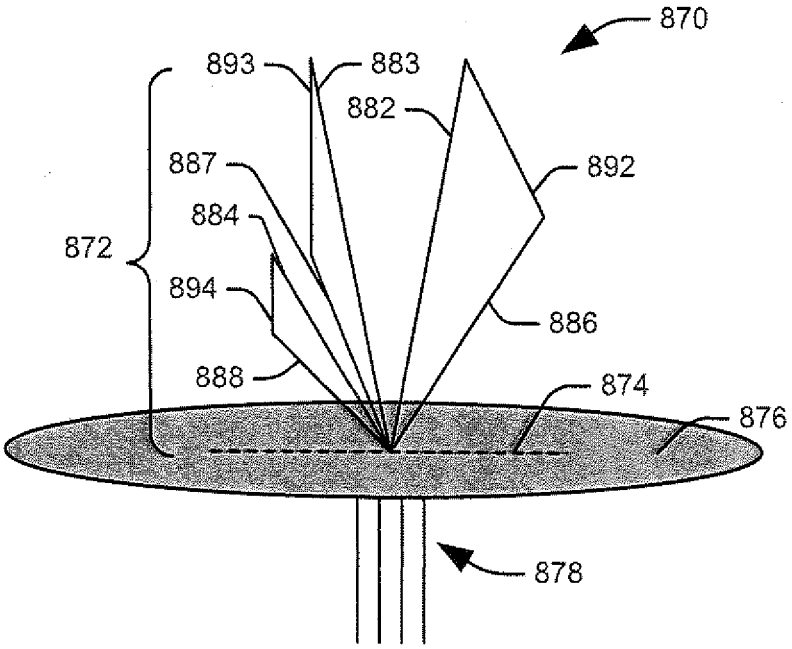
FIG. 21 illustrates a perspective view of a thirteenth exemplary implementation of an antenna assembly in accordance with an aspect of the present invention.

FIG. 21 illustrates a thirteenth exemplary implementation of an antenna assembly 870 in accordance with an aspect of the present invention. The illustrated antenna assembly 870 comprises a driven antenna assembly 872 located on a first side of an imaginary plane 874, and a ground reference 876 located at the imaginary plane or on a second side of the imaginary plane. The driven antenna assembly 872 can be driven by an antenna feed that is electrically connected to the driven antenna assembly approximately at the imaginary plane 874. In the illustrated implementation, the ground reference 876 is illustrated as planar, but it will be appreciated that other configurations of the ground plane can be utilized within the illustrated antenna assembly. The ground reference 876 may be comprised of any appropriate electrically conductive material such as, for example, copper or stainless steel. The radius of the ground reference 876 is at least one-quarter of a wavelength associated with the lowest frequency of operation.

The driven antenna assembly 872 comprises six radiative elements 882-884 and 886-888 that radiate out from a first apex. The driven antenna assembly 872 and its constituent elements 882-884 and 886-888 are formed from a conductive material. The radiative elements 882-884 and 886-888 are electrically connected to the antenna feed 878 and one another at the apex. A first set of radiative elements comprise first, second, and third radiative elements 882-884 that are generally linear and extend away from the apex at an acute angle relative to the imaginary plane 874. Each of the first, second, and third radiative antenna elements 882-884 may be at a unique acute angle or at the same acute angle relative to the imaginary plane 874. In the illustrated implementation, the first, second, and third radiative elements 882-884 are oriented such that the first, second, and third elements are spaced evenly, that is, at intervals of one-hundred and twenty degrees. Each of the first set of radiative elements 882-884 have a length within a first range of lengths associated with a characteristic lower bound frequency. For example, a first element 882 can have a length, $L_1$, tuned to be receptive to the characteristic lower bound frequency and each of the second and third elements 883 and 884 can have a length within an approximately ten percent variance of the length of the first element. Varying the lengths of the first set of radiative elements 882-884 can provide an improvement in the broadband properties of the driven antenna assembly, but it will be appreciated that a common antenna length, for example, the tuned antenna length $L_1$, can be utilized for the first set of radiative elements in while still maintain the wideband properties of the antenna.

A second set of radiative elements comprise fourth, fifth, and sixth radiative elements 886-888 that are generally linear and extend away from the apex at an acute angle relative to the imaginary plane 874. Each of the fourth, fifth, and sixth radiative antenna elements 886-888 may be at a unique acute angle or at the same acute angle relative to the imaginary plane 874 as one another or one of the first set of radiative elements 882-884. In the illustrated implementation, the fourth, fifth, and sixth radiative elements 886-888 are oriented such that they are spaced evenly between the first set of radiative elements 882-884, such that each of the second set of radiative elements is spaced at sixty degree intervals from two of the first set of radiative elements and at intervals of one-hundred and twenty degrees from one another. In accordance with an aspect of the present invention, each element of the first set of radiative elements 882-884 is connected to a corresponding one of the second set of radiative elements 886-888 by a corresponding third set of radiative elements 892-894 as to form three closed loops. In one implementation, the closed loops formed by the first, second, and third sets of radiative elements 882-884, 886-888, and 892-894 can be filled with a wire mesh or solid conductive plate to enhance the wideband characteristics of the antenna assembly 870.

In one implementation, illustrated in FIG. 21, a plane defined by each of the closed loops can be substantially perpendicular to the imaginary plane 874. It will be appreciated, however, that the depicted orientation is provided merely for the purpose of example. For example, the three sets of radiative elements 882-884, 886-888, and 892-894 can be configured such that the plane defined by each closed loop forms an oblique angle to the imaginary plane 874. An example of such a configuration could be represented by turning each closed loop depicted in FIG. 21 ninety degrees, such that the third radiative element 892-894 of each loop is substantially parallel to the imaginary plane 874.

Figure 22:
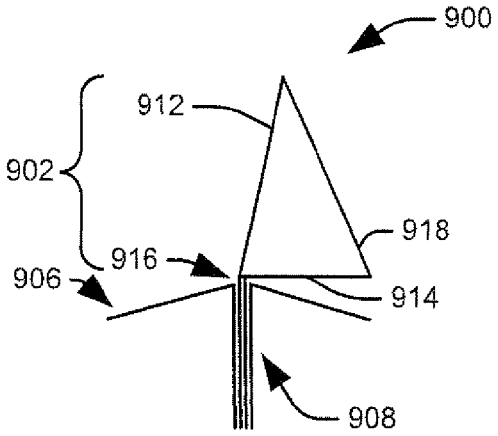
FIG. 22 illustrates a perspective view of a fourteenth exemplary implementation of an antenna assembly in accordance with an aspect of the present invention.

FIG. 22 illustrates a fourteenth exemplary implementation of an antenna assembly 900 in accordance with an aspect of the present invention. The illustrated antenna assembly 900 comprises a driven antenna assembly 902 and a ground reference 906. In the illustrated implementation, the ground reference 906 is a shallow conical structure, with a sidelength greater than a wavelength associated with a lowest operating frequency of the antenna. The driven antenna assembly 902 can be driven by an antenna feed 908, such as SMA (or similar) coaxial connector, that is electrically connected to the driven antenna assembly to connect the antenna to an associated transceiver system (not shown).

The driven antenna assembly 902 comprises first and second linear radiative segments 912 and 914 that extend outwardly from a first apex 916, and a third linear radiative segment 918 that connects the first and second linear radiative segments 912 and 914 at their distal ends to form a closed loop. In the illustrated implementation, the second linear radiative element 914 is configured to be substantially perpendicular to a first axis, defined to coincide with the antenna feed 908, and the first and third radiative elements 912 and 918 are configured to form an oblique angle relative to the first axis. The driven antenna assembly 902 and its constituent linear elements 912, 914, and 918 are formed from a conductive material. The loop formed by the first, second, and third linear radiative segments 912, 914, and 918 can be filled with a wire mesh or solid conductive plate to enhance the wideband characteristics of the antenna assembly 900.

Figure 23:
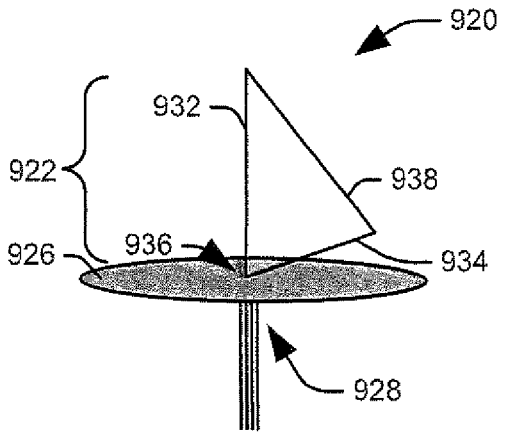
FIG. 23 illustrates a perspective view of a fifteenth exemplary implementation of an antenna assembly in accordance with an aspect of the present invention.

FIG. 23 illustrates a fifteenth exemplary implementation of an antenna assembly 920 in accordance with an aspect of the present invention. The illustrated antenna assembly 920 comprises a driven antenna assembly 922 and a ground reference 926. In the illustrated implementation, the ground reference 926 is a planar, but it will be appreciated that other configurations of the ground reference can be utilized. The driven antenna assembly 922 can be driven by an antenna feed 928, such as SMA (or similar) coaxial connector, that is electrically connected to the driven antenna assembly to connect the antenna to an associated transceiver system (not shown).

The driven antenna assembly 922 comprises first and second linear radiative segments 932 and 934 that extend outwardly from a first apex 936, and a third linear radiative segment 938 that connects the first and second linear radiative segments 932 and 934 at their distal ends to form a closed loop. In the illustrated implementation, the first linear radiative element 932 is configured to be substantially parallel to a first axis, defined to coincide with the antenna feed 928, and the second and third radiative elements 934 and 938 are configured to form an oblique angle relative to the first axis. The driven antenna assembly 922 and its constituent linear elements 932, 934, and 938 are formed from a conductive material. The loop formed by the first, second, and third linear radiative segments 932, 934, and 938 can be filled with a wire mesh or solid conductive plate to enhance the wideband characteristics of the antenna assembly 920.

Figure 24:
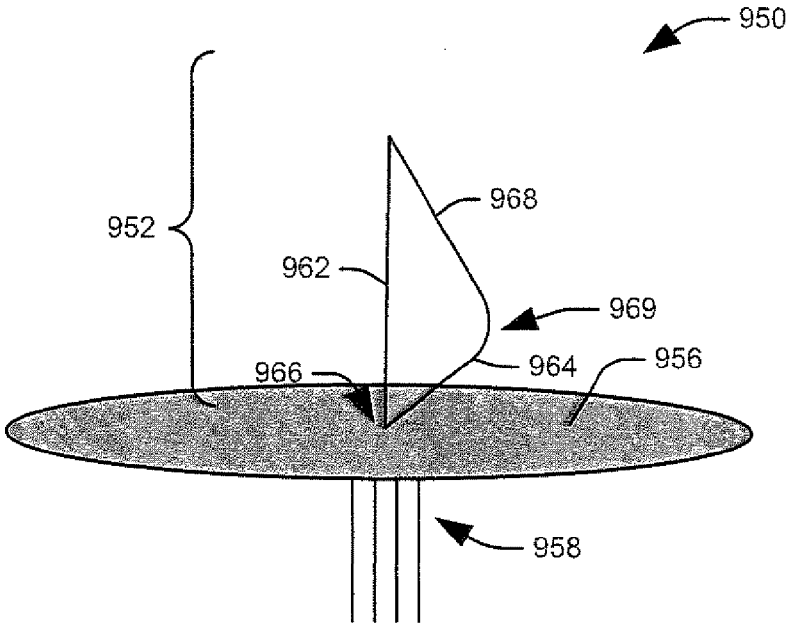
FIG. 24 illustrates a perspective view of a sixteenth exemplary implementation of an antenna assembly in accordance with an aspect of the present invention.

FIG. 24 illustrates a sixteenth exemplary implementation of an antenna assembly 950 in accordance with an aspect of the present invention. The illustrated antenna assembly 950 is a variation on the antenna assembly of FIG. 23, with a driven antenna assembly 952, a planar ground reference 956, and an antenna feed 958. Like the driven antenna assembly of FIG.

23, the driven antenna assembly 952 comprises first and second radiative segments 962 and 964 that extend outwardly from a first apex 966, and a third radiative segment 968 that connects the first and second linear radiative segments 962 and 964 at their distal ends to form a closed, substantially triangular loop. In the illustrated driven antenna assembly 952, however, each of the second radiative element 964 and the third radiative element 968 are curvilinear, such that an intersection between the second and third radiative elements at a second apex 969 forms a rounded corner. The addition of the rounded corner at the second apex 969 improves the wideband capabilities of the antenna assembly, allowing for wideband performance from a relatively easily constructed shape. It will be appreciated that the triangular loop formed by the first, second, and third linear radiative segments 952, 954, and 958 can be filled with a wire mesh or solid conductive plate to further enhance the wideband characteristics of the antenna assembly 950.

Figure 25:
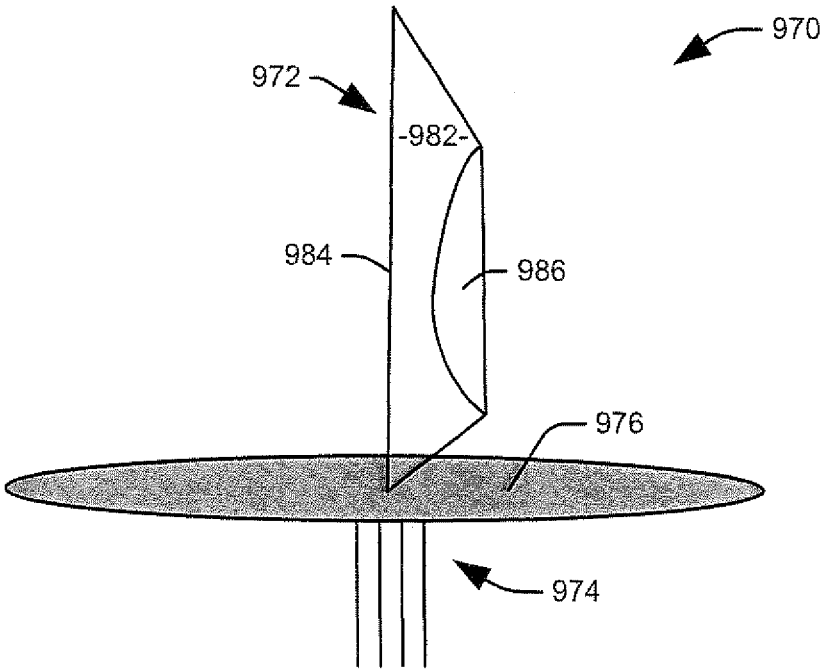
FIG. 25 illustrates a perspective view of a seventeenth exemplary implementation of an antenna assembly in accordance with an aspect of the present invention.

FIG. 25 illustrates a seventeenth exemplary implementation of an antenna assembly 970 in accordance with an aspect of the present invention. The illustrated antenna assembly 970 is a variation on the antenna assembly of FIG. 24 in which the triangular loop has been filled with a wire mesh or solid conductive plate and folded along a line substantially parallel to a first side of the triangular loop as to form a radiative element 972 connected to an antenna feed 974. In the illustrated implementation, the radiative element 972 extends primarily in a first direction from the antenna feed 974, and a planar ground reference 976 extends from a ground shield of the antenna feed in a plane substantially parallel to the first direction.

The radiative element 972 includes a first, substantially planar portion 982 bounded by a first side 984, substantially parallel to a first axis coinciding with an antenna feed, and the line of the fold, and a second, arcuate portion 986 that curves back toward an antenna feed. In the illustrated implementation, the rounded corner of the triangular loop is located at a tip of the second portion 986. The radiative element 972 is essentially a triangular plate, with one corner of the triangle folded in a substantially semicircular curve to further improve the wideband performance of the antenna assembly 970.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

Having described the invention, I claim:

1. An antenna assembly for receiving and transmitting radio frequency signals over an enhanced frequency band comprising:

an electrically conductive ground reference; and a radiative element formed from an electrically conductive material and comprising an apex, at which the radiative element is electrically connected to an antenna feed and configured such that the radiative element lacks two-fold rotational symmetry around a first axis coinciding with the antenna feed, the radiative element extending such that a distance between the radiative element and the electrically conductive ground reference increases as a radial distance from the first axis along the radiative element increases.

2. The antenna assembly of claim 1, the radiative element comprising:

a first curvilinear segment having a first end, a second end, and an associated length;

a second curvilinear segment having a first end, a second end, and an associated length, the first end of the second linear segment being electrically connected to first end of the first linear segment to for the apex; and a third linear segment connecting the second end of the first curvilinear segment to the second end of the second curvilinear segment to form a closed shape.

3. The antenna assembly of claim 2, the third linear segment being substantially perpendicular to the first axis.

4. The antenna assembly of claim 2, the third linear segment being substantially parallel to the first axis.

5. The antenna assembly of claim 2, wherein the closed shape formed by the first curvilinear segment, the second curvilinear segment, and the third curvilinear segment is filled with one of a wire mesh and a solid conductive plate.

6. The antenna assembly of claim 2, wherein each of the first curvilinear segment and the second curvilinear element are substantially linear.

7. The antenna assembly of claim 6, wherein the second curvilinear segment is substantially perpendicular to the first axis and the electrically conductive ground reference comprises a shallow conical structure, having a sidelength greater than a wavelength associated with a lowest operating frequency of the antenna.

8. The antenna assembly of claim 6, wherein the first curvilinear segment is substantially parallel to the first axis.

9. The antenna assembly of claim 2, the first curvilinear segment being substantially linear and parallel to the first axis, the first curvilinear segment and the third linear segment forming a second apex, and the second curvilinear segment and the third linear segment intersecting at a rounded corner.

10. The antenna assembly of claim 1, the radiative element comprising a substantially triangular sheet that is folded along a line substantially parallel to a first side of the triangle as to form an first, substantially planar portion and a second arcuate portion that curves back toward the antenna feed, the apex being a first apex of the triangular sheet, and a second apex of the triangular sheet, located in the arcuate portion, being rounded.

11. The antenna assembly of claim 1, the radiative element comprising an oblique, elliptical cone formed from one of a wire mesh and a solid conductive plate, the apex being an apex of the cone.

12. The antenna assembly of claim 1, wherein the electrically conductive ground reference comprises a shallow conical structure, having a sidelength greater than a wavelength associated with a lowest operating frequency of the antenna.

13. The antenna assembly of claim 1, the radiative element comprising a first radiative element of a plurality of radiative elements forming a radiative assembly, the plurality of radiative elements being configured such that the radiative assembly lacks two-fold rotational symmetry around the first axis.

14. An antenna assembly for receiving and transmitting radio frequency signals over an enhanced frequency band comprising:

a first radiative element formed from an electrically conductive material and comprising an oblique, elliptical cone operatively connected to an antenna feed at an apex;

a second radiative element formed from an electrically conductive material and comprising an oblique, elliptical cone operatively connected to the antenna feed at an apex; and an electrically conductive ground reference, wherein the first and second radiative elements collectively form a radiative assembly configured to lack two-fold rotational symmetry around a first axis coinciding with the antenna feed, each of the first and second radiative elements extending such that a distance between the radiative element and the electrically conductive ground reference increases as a radial distance from the first axis along the radiative element increases.

15. The antenna assembly of claim 14, the first radiative element and the second radiative element having different lengths, the length of the first radiative element being associated with a first characteristic frequency of the antenna assembly and the length of the second radiative element being associated with a second characteristic frequency of the antenna assembly.

16. The antenna assembly of claim 14, a first distance between an apex of the first radiant element and a point on the base of the first radiant element along a semi-major axis of the elliptical base that is closest to the electrically conductive ground reference being approximately forty percent longer than a second distance between an apex of the second radiant element and a point on the base of the second radiant element along a semi-major axis of the elliptical base that is closest to the electrically conductive ground reference.

17. An antenna assembly for receiving and transmitting radio frequency signals over an enhanced frequency band comprising:

an electrically conductive ground reference;

a first radiative element formed from an electrically conductive material and comprising a first apex, at which the first radiative element is electrically connected to an antenna feed, the first radiative element extending such that a distance between the first radiative element and the electrically conductive ground reference increases as a radial distance from the apex along the first radiative element increases; and a second radiative element formed from an electrically conductive material and comprising a second apex, at which the second radiative element is electrically connected to the antenna feed and the first radiative element, the second radiative element extending such that a distance between the second radiative element and the electrically conductive ground reference increases as a radial distance from the apex along the second radiative element increases;

wherein the first radiative element and the second radiative element have different lengths, the length of the first radiative element being associated with a first characteristic frequency of the antenna assembly and the length of the second radiative element being associated with a second characteristic frequency of the antenna assembly, and the first and second radiative elements collectively form a radiative assembly configured to lack two-fold rotational symmetry around a first axis coinciding with the antenna feed.

* * * * *